US006237654B1

(12) United States Patent
Sheyer

(10) Patent No.: US 6,237,654 B1
(45) Date of Patent: May 29, 2001

(54) DIALYSIS DRAIN BAG DRAINAGE DEVICE

(76) Inventor: Martin Sheyer, 14120 Belfour, Oak Park, MI (US) 48237

( * ) Notice: Subject to any disclaimer, the term of this patent is extended or adjusted under 35 U.S.C. 154(b) by 0 days.

(21) Appl. No.: 09/439,402

(22) Filed: Nov. 15, 1999

Related U.S. Application Data

(60) Provisional application No. 60/154,918, filed on Sep. 21, 1999.

(51) Int. Cl.[7] ..... B65B 1/04
(52) U.S. Cl. ..... 141/330; 141/114; 4/661
(58) Field of Search ..... 4/661; 141/329, 141/330, 114

(56) References Cited

U.S. PATENT DOCUMENTS

| | | | | |
|---|---|---|---|---|
| 2,083,479 | | 6/1937 | Speare . | |
| 4,101,279 | * | 7/1978 | Aslam | 4/661 |
| 4,527,716 | | 7/1985 | Haas et al. . | |
| 4,676,775 | | 6/1987 | Zolinierczyk et al. . | |
| 5,001,788 | | 3/1991 | Pacelli . | |
| 5,349,995 | | 9/1994 | Perez . | |
| 5,405,053 | | 4/1995 | Zublin . | |
| 5,503,633 | | 4/1996 | Saunders et al. . | |
| 5,671,485 | | 9/1997 | Middlestead . | |

OTHER PUBLICATIONS

Natural Gas Power Plant System (a descriptive drawing) (no date).

* cited by examiner

*Primary Examiner*—Steven O. Douglas
(74) *Attorney, Agent, or Firm*—Young & Basile, PC

(57) ABSTRACT

A drainage device is provided for rupturing and draining the fluid contents of a flexible container, such as a dialysis drain bag. A pierce element is mountable in a use position in a waste disposal receptacle so as to engage a wall of a flexible container impaled on the pierce element to rupture the container and allow the fluid contents of the container to flow into the waste receptacle. The pierce element is mounted in a holder which is adapted to be stably mounted in the waste receptacle. In one aspect, an apertured receptacle has a base wall to which the pierce element is fixedly mounted to orient the pierce element in an upstanding position below an open end and within the sidewall of the receptacle. An optional inner wall may be carried within the receptacle and disposed concavely below the open end of the receptacle for supporting a flexible wall of a container in a position for rupturing by the pierce element which projects through the inner wall. In another aspect, a pair of mounting arms are carried on the support and are adapted to fixedly engage the rim of a toilet bowl or sink to mount the drainage device in the use position. In another aspect, the inner wall or the pierce element is adapted for movement between operative and inoperative positions so as to safely dispose the pierce element in a position within the receptacle to minimize inadvertent contact bu a user.

5 Claims, 4 Drawing Sheets

DIALYSIS DRAIN BAG DRAINAGE DEVICE

CROSS REFERENCE TO CO-PENDING APPLICATION

This application claims the benefit of the priority date of co-pending Provisional Application Ser. No. 60/154,918, filed Sep. 21, 1999, the entire contents of which are incorporated herein by reference.

BACKGROUND OF THE INVENTION

Individuals suffering from kidney disease are frequently required to undergo peritoneal dialysis. This involves the use of a transfer set including a plurality of dialysis drain bags. The drain bags are in the form of flexible, expandable plastic containers typically formed of two thick sheets of plastic which are seamed or sealed about their entire peripheral edges. An elongated fill tube extends from one edge of the container.

When the drain bag or container is filled or dialysis completed, the patient or nurse typically carries the drain bag to a toilet or a special fluid waste sink. The patient then holds the drain bag in one hand and uses scissors or another sharp implement to clip an upper corner of the bag. The patient then tips the bag allowing the fluid contents of the bag to drain from the bag into the toilet.

This arrangement poses several problems. The filled drain bag is cumbersome to handle and heavy, especially for elderly patients. Further, despite careful handling, it is difficult not to spill fluid contents of the drain bag onto the patient during the draining process.

Thus, it would be desirable to provide a dialysis drain bag drainage device which is capable of simplifying the drainage of fluid contents from a dialysis drain bag.

SUMMARY OF THE INVENTION

The present invention is a drainage device capable of rupturing an opening in and draining the fluid contents of a flexible walled container, such as a dialysis drain bag.

In one aspect of the invention, the apparatus includes a pierce element mounted on a holder. The holder supports the pierce element with respect to a waste receiving receptacle to enable the pierce element to rupture a container brought into engagement with the pierce element so as to drain the fluid contents of the container directly into the waste receptacle.

The pierce element may take one of a number of difference forms as long as the pierce element provides at least one sharp tip or sharp edge in an upstanding position for engagement with the flexible container. The pierce element may comprise a knife blade having a sharp tip and/or sharp edge, a razorblade having a sharp edge, a pointed apex of a conical shaped member, a triangular shaped end portion on an elongated shank having a sharp apex and/or sharp upper edges, or an arrowhead shape having two or four circumferentially spaced sharp edges.

In another aspect, the holder and pierce element are fixedly mounted in a receptacle having an open end, a sidewall and a base. The holder is fixedly mounted on the base of the receptacle with the pierce element pointing outward toward the open end of the receptacle and surrounded by the sidewall of the receptacle. The receptacle is preferably formed with apertures allowing fluid flow therethrough. In one aspect, the receptacle is formed of a wire mesh.

In another aspect of the present invention, the receptacle includes a separate inward tapered, wall having an open lower end. The wall is mounted in the receptacle and angles inward from the open end of the receptacle toward the pierce element for directing the flexible walls of a container into contact with the pierce element to ensure rupturing of the flexible walls of the container by the pierce element.

In another aspect, the wall extends concavely across the of the receptacle below the open end of the receptacle. The tip of the pierce element extends through the inner wall for engagement with a flexible container. This aspect of the invention receives the entire sidewall of the flexible container to ensure rupturing of the sidewall by the pierce element.

In yet another aspect of the invention, at least two arms are coupled to the holder or support. Mounts are formed on the outer end of each arm for engagement with the rim of the waste receptacle, such as the rim of a toilet bowl or sink, for supporting the holder and the pierce element in an upright position within the waste receptacle.

In yet another aspect, the pierce element or blade and the base are connected to a surrounding receptacle by means of a plurality of angularly outward and upward extending arms or rods which are connected to the surrounding receptacle. The receptacle includes rim mounts for mounting the entire receptacle on the rim of a waste receptacle, such a toilet bowl or sink. The rods support the pierce element above the base wall of the receptacle, which base wall includes a plurality of apertures allowing fluid flow therethrough into the waste receptacle. A safety lid is pivotally mounted to the receptacle and movable from a safety closed position overlaying the pierce element and an open position allowing use of the pierce element to rupture a fluid filled container dropped into engagement with the pierce element. A safety member in the form of a cup is removably mountable over the pierce element to cover the pierce element when the drainage device is not in use.

In another aspect, a safety cover is pivotally attached to the sidewall of the receptacle and carries a tubular member sized to encompass the pierce element when in a first position. The safety cover is pivotal to a second position spaced from the open end of the receptacle allowing passage of the drain bag into the receptacle.

The inner wall, in another aspect, may be movably mounted in the receptacle for movement from a first position wherein the aperture in the inner wall is spaced above the pierce element so as to enable the inner wall to act as a shield covering the pierce element from exposure. The inner wall is also movable to a second position wherein the pierce element projects through the aperture in the inner wall to engage with a fluid filled container or drain bag.

In another embodiment, the inner wall, if employed, is fixed in position and the pierce element itself is movably mounted within the receptacle for movement from a first retracted position within the lower portion of the receptacle and spaced below the inner wall to a raised position wherein the pierce element extends through the aperture in the wall or is otherwise in position for engagement with a drain bag disposed within the receptacle.

The pierce element may be connected to a handle projecting from the receptacle for movement between the first and second positions independent of the use of the inner wall. Alternately, the pierce element may be rotatable mounted within the receptacle for movement from one position wherein the shape edges of the pierce element project downwardly toward the bottom of the receptacle and an opposite, rotated position wherein the pierce element projects upwardly toward the open end of the receptacle for engagement with the drain bag.

The present drainage device provides a simple means for draining the fluid contents of a flexible container, such as a dialysis drain bag. The present drainage device is inexpensive in manufacturing cost, easy to use and, more importantly, eliminates the need to support a filled drain bag while snipping one end of the drain bag and then manipulating the bag to drain the contents of the bag into a toilet as in previous drainage procedures.

The present invention enables the drain bag to be quickly and easily drained of fluid contents by any individual, particularly the elderly or incapacitated which have difficulty in supporting a filled drain bag for an appreciable length of time. The filled drain bag need only be impaled on the pierce element of the present invention which quickly ruptures the bag and drains the contents thereof without any additional handling or manipulation by the user. The present drainage device also minimizes the possibility of spillage of the bag contents which could contaminate clothing, hands, and/or surfaces surrounding the waste receptacle.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

The present invention is a kidney dialysis drain bag drainage device which is operative to a rupture or create an opening in a drain bag to allow quick discharge of the fluid contents of the bag into a convenient waste receptacle, such as a toilet, medical waste removal sink, etc.

Figure 1:
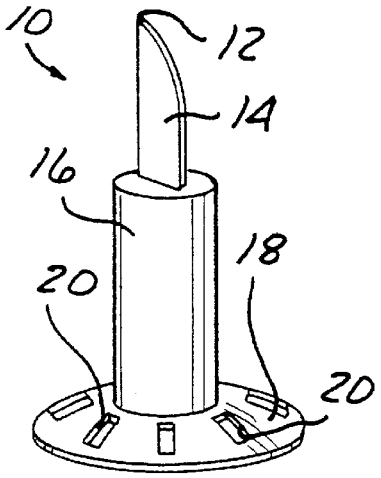
FIG. 1 is a perspective view of one aspect of a pierce element used in the drainage device of the present invention.

FIG. 1 depicts the simplest aspect of the present invention in which the drain bag drainage device 10 includes a member having a sharp point or edge 12 capable of piercing a drain bag forcibly engaged with the point or edge 12 to rupture or create an opening in the drain bag allowing the fluid contents of the bag to easily flow through the opening to empty the drain bag.

Any member capable of providing a sharp edge or point, or a plurality of separate sharp edges or sharp points, may be used as the drain bag drainage device of the present invention. In the first aspect of the invention shown in FIG. 1, the sharp point or edge 12 is formed on a knife blade 14. The knife blade 14 is mounted in a support or holder 16 so as to be disposed in a generally vertically extending, upright position, with the point or edge 12 disposed uppermost, when the device 10 is mounted in a use position, as described hereafter.

The blade 14 is mounted in the support 16 by any suitable means, such as by a press fit, adhesive, mechanical fasteners, etc.

In one aspect of the invention, the support 16 is mounted on an enlarged base 18 which is capable of supporting the blade 14 in an upright position despite forces exerted on the blade 14 when a fluid filled drain bag is forcibly impaled on the point 12 of the blade 14.

By way of example only, the base 18 is formed as an enlarged member having a generally planar or domed configuration as shown in FIG. 1. A plurality of apertures 20 are formed in the base 18 to facilitate drainage through the base 18 to a waste receptacle, such as a toilet, a sink, as described hereafter.

Figure 2:
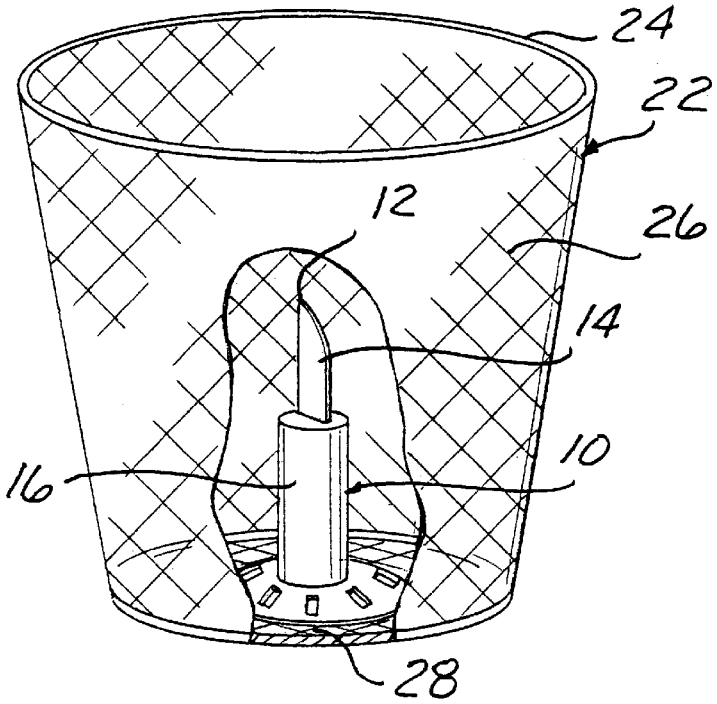
FIG. 2 is a perspective view of another aspect of a pierce element mounted in an apertured container.

Another aspect of the present invention is shown in FIG. 2 in which the support 16 also includes an enlarged receptacle or container 22 sized to receive a substantial portion of the drain bag as described hereafter. By way of example only, the receptacle 22, as shown in FIG. 2, is in the form of a wire basket having an open upper end 24, a wire mesh sidewall 26, and a wire mesh base 28. The drainage device 10 may be mounted to the base 28 of the receptacle 22 by suitable means, such as welding, mechanical fasteners, etc. Further, the drainage device 10 including only the blade 14 and the support 16 may be mounted on the base 28 of the receptacle 22 with or without the use of the base 18 shown in FIG. 1.

Figure 7:
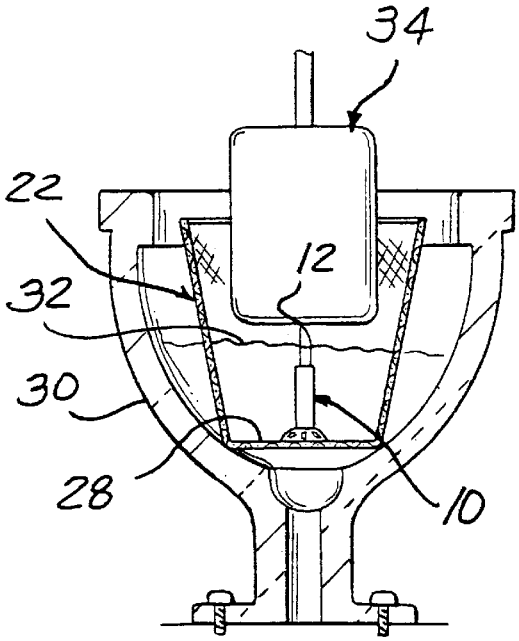
FIG. 7 is a side elevational view showing the use of the drain bag drainage device shown in FIG. 2 in use.

The receptacle 22 is formed of a non-corrosive material, such as plastic (i.e. PVC plastic), stainless steel, aluminum, plastic coated metal, etc. As shown in FIG. 7 and described hereafter, the receptacle 22 has a height between the upper end 24 and the base 28 such that the upper end 24 is positioned above the water level in a toilet 30 when the receptacle 22 is mounted in a use position in the toilet 30 with the base 28 disposed on the lower inside portion of the toilet bowl 30 above the discharge opening of the bowl 30. Further, the overall length of the pierce element, including the blade 14 and/or the length of the support 16 is chosen so as to place the sharp point or edge 12 of the pierce element 14 above the water surface 32 so that engagement between the sharp point 12 and a dialysis drain bag 34 occurs above the water surface 32 to facilitate quick drainage of the fluid contents of the drain bag 34 into the toilet bowl 30.

Figure 3:
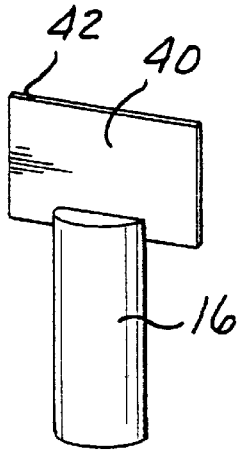
FIGS. 3–6 are perspective views of alternate piece elements employable in the present invention.

The pierce element of the present device 10 may take many different forms. As shown in FIG. 3, the pierce element is in the form of a razorblade 40 having at least one sharp edge 42 which is disposed uppermost in the support 16.

Figure 4:
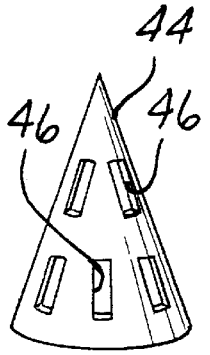

Alternately, as shown in FIG. 4, the support 16 and the pierce element may be combined into an enlarged, conical shaped member 44 which has a base complimentary to the size and shape and base 28 in the receptacle 22 so as to be removably supported on the base 28 without the need for additional fasteners, adhesive, etc. Alternately, the conical shaped support 44 may be smaller in overall diameter so as to be used without the receptacle 22 and placed directly on the bottom portion of the toilet bowl 30. The conical support 44 may be formed as a hollow member with apertures 46 extending through the sidewall to facilitate drainage of the drain bag 34.

Figure 5:
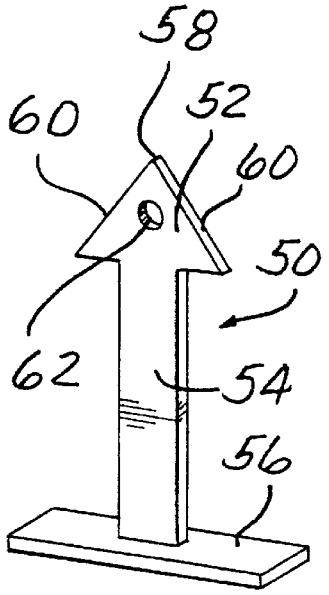

FIG. 5 depicts yet another aspect of the pierce element of the present invention in which a pierce element 50 is in the form of a pointed, triangular shaped head 52 mounted or integrally formed on an elongated rod 54. The rod 54 is in turn fixedly connected to the tubular member 56 by means of integral formation of a molded plastic material, mechanical fasteners where the rod 54 and the tubular member are constructed as separate members, adhesive, etc. The tubular member 56 is in turn fixedly mounted to the base 28 of the receptacle 22 by welding, mechanical fasteners, adhesive, etc.

The head 52 is formed with a sharp point 58 as well as optional sharp edges 60 extending angularly from the point 58. An aperture 62 may be formed in the head 52 to receive a hook member, not shown, to facilitate removal of the pierce element 50 itself or the entire receptacle 22 from the toilet bowl 30.

Figure 6:
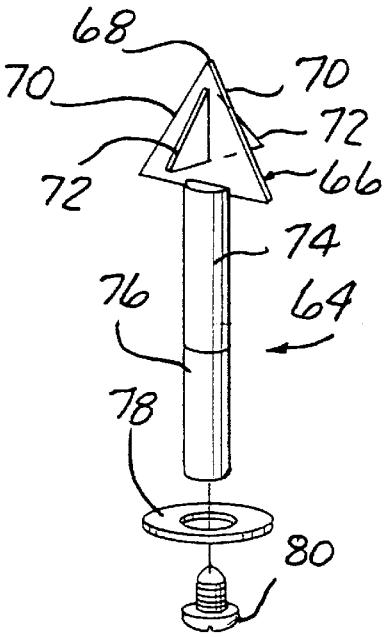

Another aspect of a pierce element 64 according to the present invention is shown in FIG. 6. In this aspect, the pierce element 64 is in the form of a bladed arrowhead 66 having a sharp point or apex 68 and at least two sharp angularly extending edges 70. Optionally, the arrowhead 66 may be formed with additional blades 72, each with an outer sharp edge, arranged transverse to the edges 70. This provides four sharp edges and a point to quickly create a larger aperture in the drain bag 34.

The arrowhead 66 may be a conventional arrowhead having a shank 74 which is threaded or otherwise connected to an elongated shaft 76. The shaft 76 may be mounted on the base 18 or interconnected to the base 28 of the receptacle 22 by means of a washer 78 and mechanical fastener or screw 80.

Regardless of which pierce element is employed, (the pierce element in the form of the blade 14 shown in FIG. 1 will be used as an example only) the drain device 10, by itself or when mounted in the receptacle 22, is disposed on the bottom surface of a toilet bowl 30, as shown in FIG. 7, with the sharp point or edge 12 of the pierce element extending above the water surface 32. The lower portion of the drain bag 34 is then forcibly engaged or impaled on the sharp point 12 such as by a quick dissent of the drain bag 12 onto the point 12.

The point 12 ruptures the plastic wall of the drain bag 34 generally along the bottom edge seam of the drain bag 34 creating an aperture in the drain bag which allows the fluid contents of the drain bag to flow out of the drain bag 34 and into the toilet bowl 30.

The drain bag 34 may then be discarded. The receptacle 22 and drainage device 10 are then removed from the toilet bowl 30 and cleaned for a subsequent use.

Figure 8:
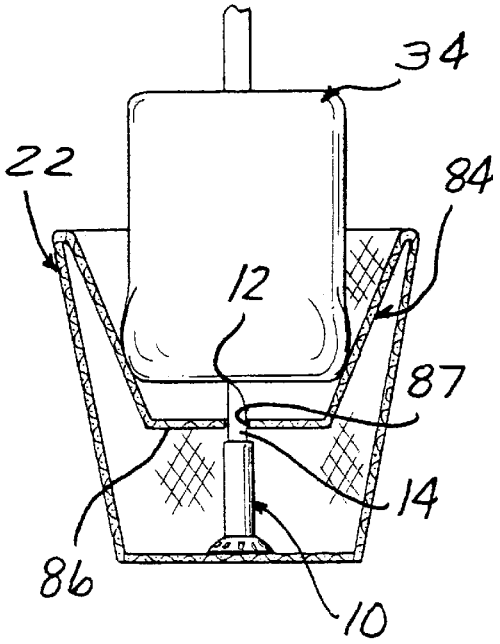
FIG. 8 is a side elevational view of another aspect of the present invention.

In order to ensure that the sharp point 12 of the blade 14 or pierce element successfully pierces the plastic wall of the drain bag 34, rather than deflecting to the side in the event that the drain bag 34 is not impaled on the sharp point 12 with sufficient force, an alternate aspect of the present invention, shown in FIG. 8, includes an inward tapered funnel 84 formed of one more sidewalls, generally the same construction as the sidewall 26 of the receptacle 22. The funnel 84 extends from an upper edge 24 of the receptacle 22 to a lower end 86 spaced above the base 28 of the receptacle 22. An aperture 87 may be formed in the lower end 86 of the funnel 84 to allow the blade 14 to project therethrough such that the sharp point 12 of the blade 14 engages the lower end of the drain bag 34 above the lower end 86 of the funnel 84.

Although the lower end 86 of the funnel 84 may be open, it is preferred that a bottom wall be formed at the lower end 86 of the funnel 84 to support the lower end of the drain bag 34. The aperture 87 formed in the bottom wall is spaced form the edges of the pierce element 14 to provide a side clearance for flaps formed on the lower end of the drain bag 34 by the rupture of the drain bag 34 by the pierce element 14. The flaps on the drain bag 34 can pass through the side clearance space thereby maintaining the rupture in the drain bag 34 open so as to ensure that all of the fluid contents of the drain bag 34 are drained therefrom.

The inward tapered sidewall of the funnel 84 forces the lower portions of the drain bag 34 inward. This generally flattens or enlarges the lower surface of the drain bag 34 to ensure that the sharp point 12 on the blade 14 will forcibly engage and create an aperture in the drain bag 34.

To facilitate drainage of the fluid contents of the drain bag 34, the funnel 84 is preferably formed with a plurality of apertures. In an exemplary embodiment, the funnel 84 is formed of the same wire mesh forming the sidewall 26 and base 28 of the receptacle 22.

Figure 9:
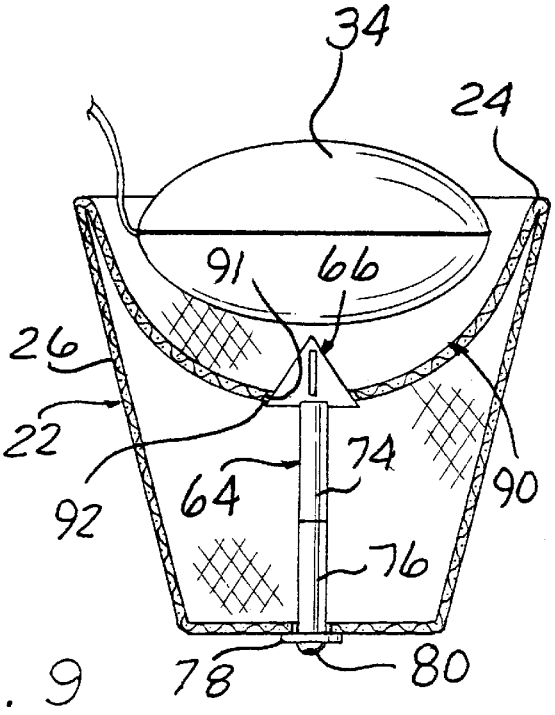
FIG. 9 is a side elevational of yet another drain bag drainage device according to the present invention.

Yet another aspect of the present invention is shown in FIG. 9 which depicts the pierce element in the form of the arrowhead 66 shown in FIG. 5 and described above mounted on the dome-shaped support 18 similar to that shown in FIG. 1. The dome-shaped support 18 is fixedly mounted on the base 28 of the receptacle 22 as also described above.

In this aspect of the invention, a generally concave or inward tapered member or receiver 90 is mounted within the interior of the receptacle 22 and is supported at the upper end 24 of the receptacle 22. The member or receiver 90 has a concave shape by way of example only. The receiver 90 may be formed of the same wire mesh material used to form the receptacle 22. An aperture 91 is formed in a lowermost apex or bottom portion of the receiver 90 to enable the tip or end of the arrowhead 66 to extend therethrough such that the arrowhead 66 is disposed above the bottommost point or apex 92 of the receiver 90. As with the embodiment shown in FIG. 8, the side edges of the aperture 91 are spaced from the side edges of the pierce element or arrowhead 66 to enable flaps formed in the bottom portion of the drain bag 34 after the drain bag 34 is ruptured by the pierce element 66 to slide through the aperture 91 thereby ensuring that the opening in the drain bag 34 remains open to drain all of the fluid contents of the drain bag 34 therefrom.

Due to the generally curved or concave shape of the receiver 90, the drain bag 34 may be inserted through the open end of the receptacle 22 in a sideways manner with the longitudinal axis of the drain bag 34 generally perpendicular to the longitudinal axis of the arrowhead 66. In this orientation, the sidewall of the drain bag 34 presents a large surface area thereby ensuring that the pierce element or arrowhead 66 consistently forms an aperture in the drain bag 34 while avoiding engagement of the arrowhead 66 with the seam on the bottom end of the drain bag 34 as described above and shown in FIG. 8. This increases the possibility that a large aperture will formed in the drain bag 34 which speeds up the drainage of the entire fluid contents of the drain bag 34.

In summary, there has been disclosed a unique device for draining a flexible, fluid container, such as a dialysis drain bag. The device includes a pierce element mounted on a support which supports the pierce element in a position to pierce the fluid container impaled on the pierce element.

In one aspect of the invention, the pierce element is supported on a support mountable in a drainage receptacle, such as toilet bowl, sink, etc. Alternately, the support may be fixedly mounted on the base of an apertured receptacle, such as a wire mesh basket to facilitate handling of the drain device.

The pierce element may take many different forms so as to present one or more sharp points or edges to create the largest possible aperture in the drain bag to more quickly drain the fluid contents of the drain bag.

Figure 10:
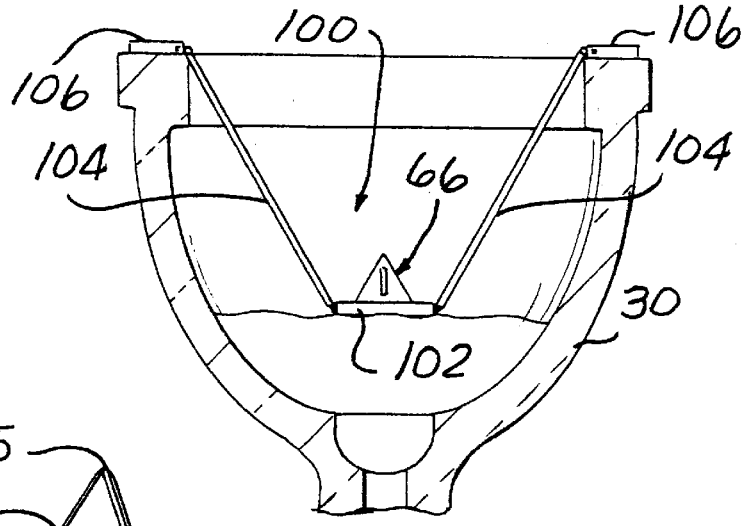
FIG. 10 is a cross sectional view of yet another drain bag drainage device according to the present invention.

FIG. 10 depicts yet another embodiment of the drain device 100 according to the present invention. The device 100 may employ any of the piercing elements described above. Thus, the use of the arrowhead 66 will be understood to be example only.

The arrowhead 66 is mounted on a platform 102, such as a plate, tubular rod, etc. At least two and preferably three arms 104 are connected to the platform 102, either in a fixed connection, such as by welding, the use of mechanical fasteners, etc., or in a movable connection via hinges.

The opposite end of the arms are coupled to toilet bowl support members 106. The support members 106 may be planar plates which rest on the upper surface of the toilet bowl rim. Alternately, the supports 106 may take the form of an L-shaped or U-shaped clamp which fits over the toilet bowl rim.

The arms 104 and supports 106 function to contain the drain device, and, in particular, the piercing elements, such as piercing element 66, in a centered position with a toilet bowl 30.

It will be understood that the arms 104 and supports 106 may also be coupled to the receptacle 22 to center the receptacle in a toilet bowl 30.

Figure 11:
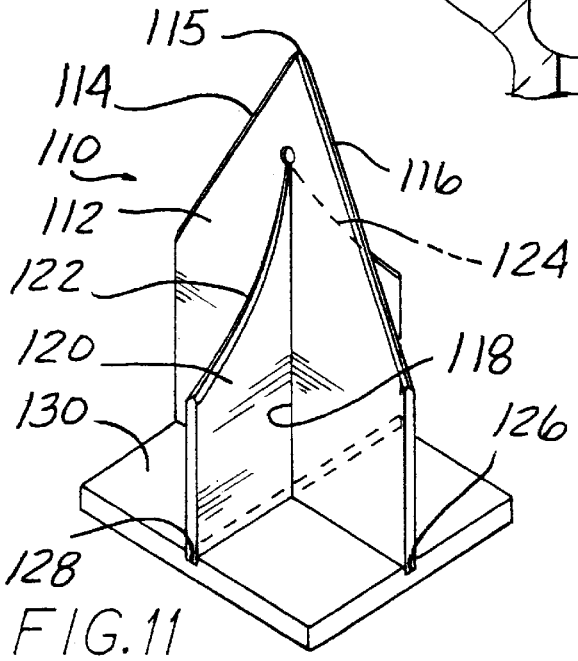
FIG. 11 is a perspective view of another aspect of a pierce element according to the present invention.

An alternate construction of the pierce element shaped as an arrowhead 110 is shown in FIG. 11. In this aspect of the invention, the pierce element 110 includes a first member 112 having an triangular end portion with two opposed sharpened edges 114 and 116. A central, longitudinally extending slot 118 extends from one end of the first member 112 toward a closed end spaced from an apex 115 of the first member 112. The slot 118 receives a second member 120 which is slidably insertable therein. The second member or element 120 also includes a pair of angled sharp edges 122 and 124. The sharpened edges 114, 116, 122, and 124 are spaced approximately 90° apart when the two members 112 and 120 are joined together.

The bottom ends of the first and second members 112 and 120 are fixedly mountable in slots 126 and 128, respectively, in a base or platform 130.

Figure 12:
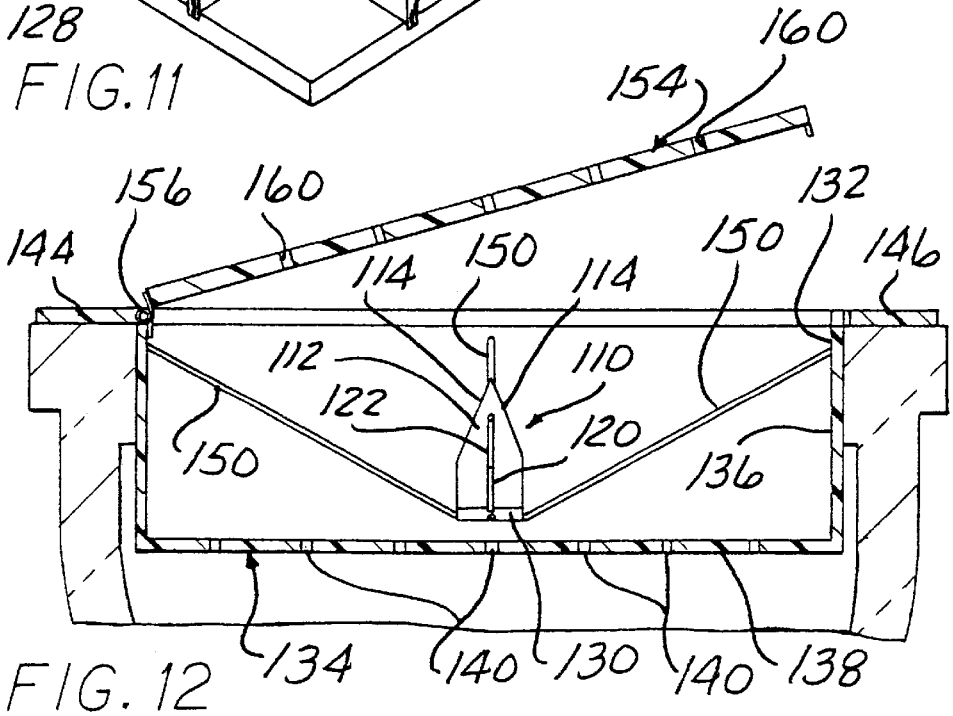
FIG. 12 is a partially cross sectioned, side elevational view of a drainage device constructed according to another aspect of the present invention.

FIG. 12 shows the pierce element 110 and platform 130 mounted in a generally circular cross section receptacle denoted by reference number 134. The receptacle 134 is formed as a one-piece body having an annular sidewall 136, a base or bottom wall 138 containing a plurality of randomly or uniformly spaced apertures 140, such as a circular perforations, etc., and an open top end 132. At least a pair of outwardly extending mounts 144 and 146 are fixed to the upper edge of the sidewall 136 and project outwardly from the sidewall 136. The mounts 144 and 146 are adapted to engage the rim of a toilet bowl to support the receptacle 134 in a use position slightly below the rim of the toilet bowl.

A plurality of rods 50, such as at least two, with four being preferred, rods 150 are fixedly connected at one end to the platform 130 and at another end to the sidewall 136 inboard of the mounts 144 and 146 to support the pierce element 110 in a use position with the sharpened edges 114, 116, 122 and 124 in an upward facing orientation for contact with the flexible container.

The arms 150 also ensure that the walls of the flexible container do not drape over the platform 130 after being ruptured by the pierce element 110 such that all of the fluid contents of the container are drained through the ruptured opening rather than being trapped within a folded over portion of the container adjacent to the rupture.

A safety lid 154 is provided for the open end of the receptacle 134. The lid 154 comprises a generally planar member of circular peripheral shape which is hinged at hinge 156 to the receptacle 134 allowing the safety lid 154 to be moved from a first closed position overlaying the open top end of the receptacle 134 and covering the pierce element 110, and a raised position spaced from the pierce element 110 allowing a fluid filled bag, not shown, to be inserted through the open end of the receptacle 134 into contact with the pierce element 110 for rupturing and drainage of the fluid contents therefrom.

The safety lid 154 also includes a plurality of centrally located perforations or slots 160.

Figure 13:
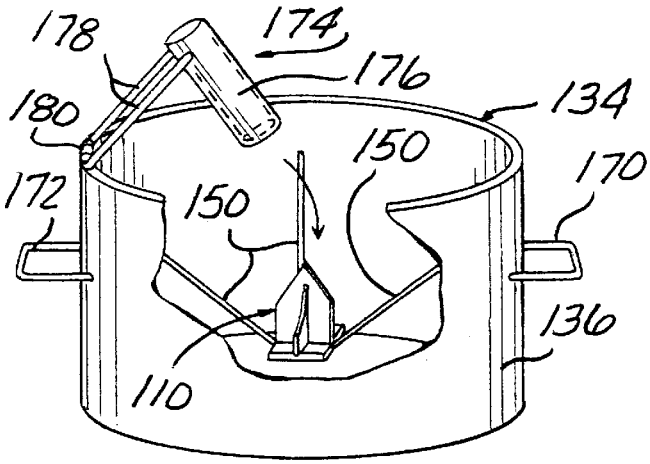
FIG. 13 is a partially broken away, perspective view of another aspect of the present invention showing a pivotal safety cover.

FIG. 13 depicts another aspect of the present invention which shares many of the same features as the aspect shown in FIG. 12 and described above. In this embodiment, the mounts 170 and 172 extending from the sidewall 136 of the receptacle 134 are formed of bent rod. Further, it will be understood that although the mounts 170 and 172 could be connected to the upper end of the sidewall 136 of the receptacle 134, it is preferable to have the mounts 170 and 172 mounted intermediately between opposed ends of the sidewall 136. This arrangement will place the sharp pierce element 110 further below the upper end of the sidewall 136 for added safety.

FIG. 13 also depicts a unique feature which is in the form of a safety cover 174. The safety cover 174 is, by example, in the form of a hollow tubular member 176 which is joined to a strap or pair of arms 178 hinged at one end by a suitable hinge 180 to the sidewall 136 of the receptacle 134. The safety cover 174 is pivotal between a first position disposed at least perpendicular to the sidewall 136 of the receptacle 134 and spaced from the pierce element 110, and a second position wherein the safety cover 174 overlays completely encompasses the pierce element 110 to prevent any inadvertent contact with the sharp edges of the pierce element 110.

Figure 14:
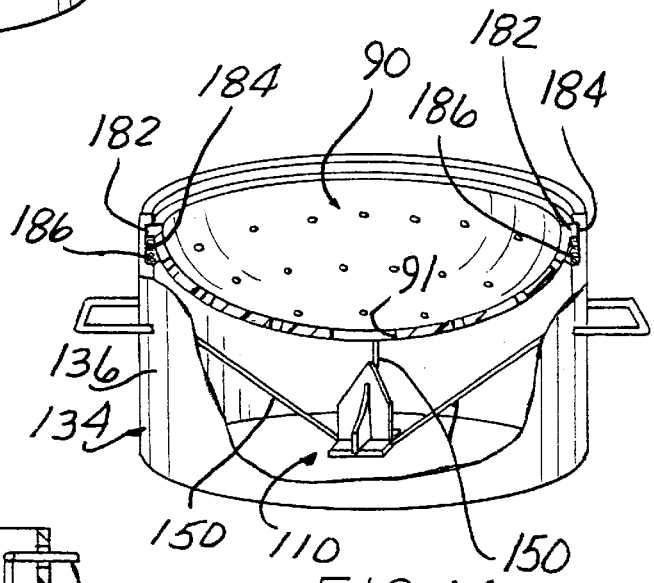
FIG. 14 is a partially broken away, perspective view showing another aspect of the present invention having a movable inner wall.

FIG. 14 depicts another aspect of the present invention which provides added safety insofar as preventing inadvertent contact with the sharp edges of the pierce element 110. In this embodiment, the generally concave shaped inner wall 90 carrying a bottommost aperture 91 for receiving an end portion of the pierce element 110 therethrough, as described above, is movably mounted within the receptacle 136 for movement between a first position shown in FIG. 13 wherein the bottommost portion of the inner wall 90 is spaced above the entire pierce element 110 thereby acting as a shield over the pierce element 110, and a second position, after depression, wherein the upper end portion of the pierce element 110 extends through the aperture 91 and is positioned for rupturing a drain bag 34 placed on the inner wall 90.

Although any movable mechanism may be employed, by way of example only, a pair of outwardly extending projections 182 are formed on opposite sides of the inner wall 90. The projections 182 slidable engage a recess 184 formed on the inner surface of the sidewall 136 of the receptacle 134. A biasing means, such as a coil spring, is also disposed in each recess 184 for normally biasing the inner wall 90 to the first position shown in FIG. 14.

In operation, the inner wall 90 will normally be disposed in the first position shown in FIG. 14 wherein the entire pierce element 110 is spaced below the aperture 91 in the inner wall 90. However, downward force exerted on the inner wall 90, such as that caused by the downward movement of the drain bag 34 into the interior of the inner wall 90 will cause the inner wall 90 to move downward within the receptacle 134 to the second position, allowing the pierce element 110 to slide through the aperture 91 in the inner wall and engage and rupture the drain bag 34.

Figure 15:
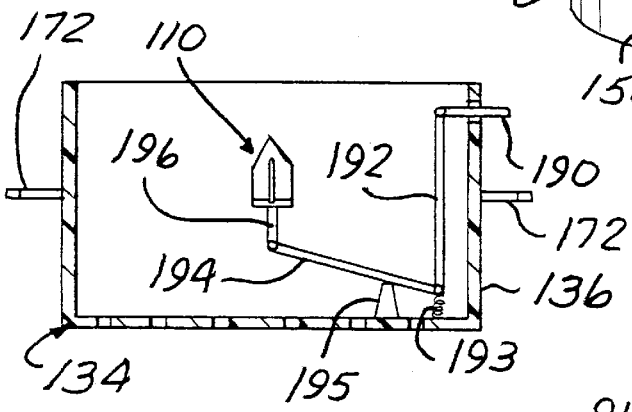
FIG. 15 is a side elevational, cross sectional view showing a movable pierce element according to another aspect of the present invention.

FIG. 15 depicts yet another aspect of the present invention in which only the pierce element 110 is movable, rather than the inner wall 90. In this embodiment, the receptacle need not include an inner wall 90.

As shown in FIG. 15, the mounts 170 and 172 are disposed intermediate opposite ends of the sidewall 136 of the receptacle 134. A handle 190 projects through an aperture formed in the upper portion of the sidewall 136. The handle 190 is attached to a linkage disposed within the interior of the receptacle 134. The linkage, by way of example only, includes a first link 192, a second link 194 and a third link 196. A biasing spring 193 may be interposed between the bottom of the receptacle 134 and one end of the link 192 for normally biasing the link 192 and the handle 190 to a first position in which the pierce element 110 is retracted the furthest distance into the interior of the receptacle 134.

A fulcrum 196 is mounted on the bottom wall of the receptacle 134 between opposite ends of the second link 194. The fulcrum 196 and the second link 194 dispose the first link 192 and the third link 196 for movement in opposite directions. In this manner, a downward force exerted on the handle 190 will move the first link 192 in a downward direction toward the bottom of the receptacle 134. The fulcrum 196 and the second link 194 will transfer this downward force into an opposite, upward directed force causing movement of the third link 196 which is attached to and carries the pierce element 110 at one end in an upward direction to bring the pierce element 110 into an operative position within the receptacle 134 for rupturing an opening in a drain bag 34 dropped the receptacle 134 as described above. After the drain bag 34 has been completely drained of fluid, release of the downward force on the handle 190 will enable the biasing spring 193 to return the handle 190 and the first 192 to the first position. Simultaneously, the third link 196 moves downward retracting the pierce element 110 into a lowermost position within the receptacle 134.

Figure 16:
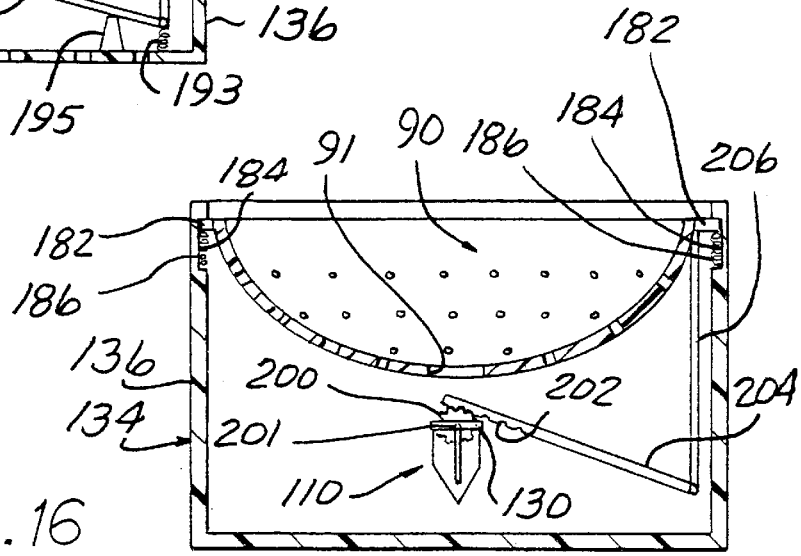
FIG. 16 is a side elevational, cross sectional view showing a movable inner wall and rotatable pierce element according to another aspect of the present invention.

It is also possible within the scope of the present invention to provide a pierce element 110, as shown in FIG. 16, which itself is movable between first and second positions wherein, in the first position, the shape edges of the pierce element 110 are disposed in a downward position, facing away from the open end of the receptacle 134, and in a second position, not shown, the shape edges of the pierce element 110 project upwardly toward the open end of the receptacle 134 for engagement with a drain bag 34 as described above.

Any suitable moving means my be employed. By example only, the base or platform 130 of the pierce element 110, as shown in FIG. 16, is movable mounted within the receptacle 134 on a pivot pin or axle 201. A gear 200 is also mounted on the axle 201 and engages a rack 202 formed at one end of a link 204. The opposite end of the link 204 is pivotally connected to a second link 206 which extends along the sidewall 136 of the receptacle 134. The upper end of the link 206 is coupled to the inner wall 90 and is movable with the inner wall 90 as described above and shown in FIG. 14. In this manner, the placement of a filled drain bag on the inner wall 90 will cause the inner wall 90 to move downwardly within the receptacle 134. Simultaneous with this downward movement, the links 204 and 206 rotate the gear 200 bringing the pierce element 110 into an operative position wherein the upper end portion of the pierce element 110 projects through the aperture 91 in the inner wall 90 for engagement with the drain bag 34.

When the drain bag 34 has been completely empted of fluid, the reduced weight of the drain bag 34 will enable the biasing means 184 to move the inner wall 90 back to the uppermost position causing a reverse movement of the links 204 and 206 which retracts the pierce element 110 to the inoperative, generally downward facing position shown in FIG. 16.

It will also be understood that the link 206, rather than being coupled to the inner wall 90 may also be provided with a handle, similar to handle 190 in FIG. 15 so as to be operative without the inner wall 90.

In summary, there has been disclosed a unique drainage device which is capable of quickly and easily draining the fluid contents of a flexible bag by providing a piercing element which is positioned by a support and/or base with an optional surrounding receptacle in a waste receiving receptacle, such as a toilet or sink, to enable the flexible bag to be impaled on the piercing element thereby rupturing the bag and allowing the fluid contents of the bag to be automatically discharged into the waste receptacle.

The drainage device of the present invention is embodied in many different forms, all of which present a simplified construction for a low manufacturing cost, ease of use, ease of cleaning and non-use storage.

What is claimed is:

1. An apparatus for draining the fluid contents of a flexible container into a waste receptacle, the apparatus comprising:

a pierce element adapted to be positioned in a waste receptacle to enable the pierce element to rupture a flexible container brought into engagement with the pierce element and drain the fluid contents of the container directly into the waste receptacle;

a receptacle having an open end, a sidewall, and a base opposing the open end, the pierce element fixedly mounted in the base of the receptacle with a cutting surface of the pierce element facing the open end of the receptacle and surrounded by the receptacle; and a plurality of apertures in the receptacle for discharging the fluid contents of the container from the receptacle to the waste receptacle immediately upon receipt of the flexible container by the pierce element.

2. The apparatus of claim 1, wherein at least certain of the apertures are formed in at least the base of the receptacle.

3. An apparatus for draining the fluid contents of a flexible container into a waste receptacle, the apparatus comprising:

a pierce element adapted to be positioned in a waste receptacle to enable the pierce element to rupture a flexible container brought into engagement with the pierce element and drain the fluid contents of the container directly into the waste receptacle;

a receptacle having an open end, a sidewall, and a base opposing the open end, a holder fixedly mounted on the base of the receptacle with the pierce element carried by the holder and pointing outward toward the open end of the receptacle and surrounded by the receptacle;

apertures formed in at least the base of the receptacle; and wherein the receptacle is formed of a mesh material having a plurality of open apertures.

4. An apparatus for draining the fluid contents of a flexible container into a waste receptacle, the apparatus comprising:

a pierce element adapted to be positioned in a waste receptacle to enable the pierce element to rupture a flexible container brought into engagement with the pierce element and drain the fluid contents of the container directly into the waste receptacle;

at least two arms coupled to the pierce element and extending outward therefrom;

a receptacle having a sidewall, a base wall and an open end opposed from the base wall adapted to be disposed with an opening in a waste receptacle;

mounts carried on the receptacle for removably mounting the receptacle on a rim of a waste receptacle;

the arms fixedly connected to the receptacle for supporting the pierce element in a piercing position completely within the interior of the receptacle; and a lid pivotally mounted to the receptacle and movable from a first closed position overlaying and covering the pierce element to a second raised position, spaced from the pierce element.

5. An apparatus for draining the fluid contents of a flexible container into a waste receptacle, the apparatus comprising:

a pierce element adapted to be positioned in a waste receptacle to enable the pierce element to rupture a flexible container brought into engagement with the pierce element and drain the fluid contents of the container directly into the waste receptacle;

a receptacle having an open end, a sidewall, and a base opposing the open end, a holder fixedly mounted in the base of the receptacle with the pierce element carried by the holder and pointing outward toward the open end of the receptacle and surrounded by the receptacle; and a safety cover pivotally mounted to the receptacle and movable between a first position spaced from the pierce element and the open end of the receptacle and a second position encompassing the pierce element.

* * * * *